United States Patent [19]

Stafford

[11] 4,248,357

[45] Feb. 3, 1981

[54] FLOATING ROOF DRAIN

[75] Inventor: Donald C. Stafford, Hinsdale, Ill.

[73] Assignee: Chicago Bridge & Iron Company, Oak Brook, Ill.

[21] Appl. No.: 70,096

[22] Filed: Aug. 27, 1979

[51] Int. Cl.[3] ..... B65D 87/18

[52] U.S. Cl. ..... 220/219

[58] Field of Search ..... 220/216-227; 52/3-5; 4/172.12, 172.13, 172.14

[56] References Cited

U.S. PATENT DOCUMENTS

| | | | |
|---|---|---|---|
| 1,592,244 | 7/1926 | Wiggins | 220/219 |
| 4,034,887 | 7/1977 | Sherlock | 220/219 |

FOREIGN PATENT DOCUMENTS

| | | | |
|---|---|---|---|
| 236427 | 7/1911 | Fed. Rep. of Germany | 220/219 |

*Primary Examiner*—George T. Hall

*Attorney, Agent, or Firm*—Merriam, Marshall & Bicknell

[57] ABSTRACT

A drain for gravity removal of water from the deck of a floating roof in a tank. The drain comprises a flexible coiled hose having a lower outlet end in communication with a conduit inlet in a lower portion of the tank, and an upper inlet end in communication with a sump space on the floating roof deck. The coiled hose is extensible in length for a distance at least equal to the height the floating roof is vertically displaceable in the tank when it is full and empty of liquid.

6 Claims, 5 Drawing Figures

10
12
14
15
17
22
24
25
27
28
29
30
33
35
36
37
39

FLOATING ROOF DRAIN

This invention relates to floating roof tanks and more particularly to a new and improved drain for a floating roof tank.

BACKGROUND OF THE INVENTION

Floating roof tanks are quite generally employed for the storage of volatile liquids, particularly petroleum products, where it is desired to minimize evaporation losses. In this form of tank, the top closure or roof floats upon the surface of the stored product and rises and falls with the level of liquid within the tank. As the normal position of the floating roof is below the top edges of the tank, it is clear that means must be provided for draining rain water from the surface or deck of the roof to preserve its stability and buoyancy. Accordingly, it is customary to pitch the roof deck toward one or more sumps in which rain water is collected and to provide a conduit connected to the sump and leading downward therefrom through the liquid in the tank, to dispose of the collected water. The drain may be connected to an outlet in the tank wall or bottom so as to dispose of the water.

PRIOR ART

The most commonly employed floating roof drain is a flexible hose having one end attached to the sump and having its other end attached to an outlet at the bottom of the tank. Many difficulties, however, arise in the operation of a simple flexible drain. For example, if the drain were to become partially filled with air or vapor, it is apt to loop upwardly in the stored product and thus destroy the normal gradient from the sump to the outlet. In addition, as the roof descends in the tank due to the lowering of the liquid level, the gradient of the hose through the liquid becomes increasingly smaller. In addition, flexible hoses often become fouled if they are allowed to float freely in a tank.

Representative of the United States patents pertaining to or disclosing floating roof drains for removing water are Moyer U.S. Pat. Nos. 2,601,316; 2,643,023; 2,657,821 and 2,886,204; Larsen U.S. Pat. No. 2,846,109; and Wissmiller U.S. Pat. No. 3,120,320. These patents show water drain lines running from a floating roof sump, through the stored liquid product, to an outlet in the tank lower portion.

It was recognized in the Moyer U.S. Pat. No. 2,643,023 as desirable for the floating roof to be able to land on the tank bottom when the tank was empty of product. Moyer realized that the water drainage systems usually prevented this, so that he proposed a drainage system using a drum, on the roof, on which the hose could be reeled when not needed and thereby kept from beneath the roof. The system of Moyer, while useful, is more complex than desired.

SUMMARY OF THE INVENTION

According to the invention, there is provided an improved drainage system for floating roof tanks which permits the floating roof to land on the tank bottom when the tank is empty. The improved drainage system is characterized by a hose which essentially maintains its vertical position during vertical displacement of the floating roof.

The invention more specifically provides an improved drainage system for a cylindrical tank, for the storage of a liquid, having a floating roof with a diameter less than the internal diameter of the tank and adapted to float on the liquid, and with said floating roof deck or top being open to the weather, with the drain improvement for gravity removal of water from the deck of the floating roof comprising a flexible coiled hose having a lower outlet end in communication with a conduit inlet in a lower portion of the tank, and an upper inlet end in communication with a sump space on the floating roof deck, and with said coiled hose being extensible in uncoiled length for a distance at least equal to the height the floating roof is vertically displaceable in the tank when it is full and empty of liquid.

The hose is desirably vertically coiled, and with the coils of essentially the same diameter, when the hose is in coiled condition and not subject to tension. Furthermore, in its coiled form, free of significant tension, each revolution of the hose has a pitch equal to about the outer diameter of the hose, so that each single twist or revolution of the hose rests on the top of the hose portion beneath it.

A housing for the coiled hose is provided at the tank bottom of such size as to receive the entire coiled hose when the roof rests on or near the tank bottom. The housing is preferably located in the tank bottom and has a bottom, side walls and an open upper end joined to the tank bottom. The conduit for removing the water from the hose will desirably have an inlet joined to the lower outlet end of the hose in the lower part of the housing, and the conduit desirably extends outwardly beneath the tank bottom. Also, the housing bottom is generally provided with a drain conduit for withdrawing liquid product therefrom.

DETAILED DESCRIPTION OF THE DRAWINGS

So far as is practical, the same or similar elements or parts which appear in the various views of the drawings will be identified by the same numbers.

Figures 1, 2:
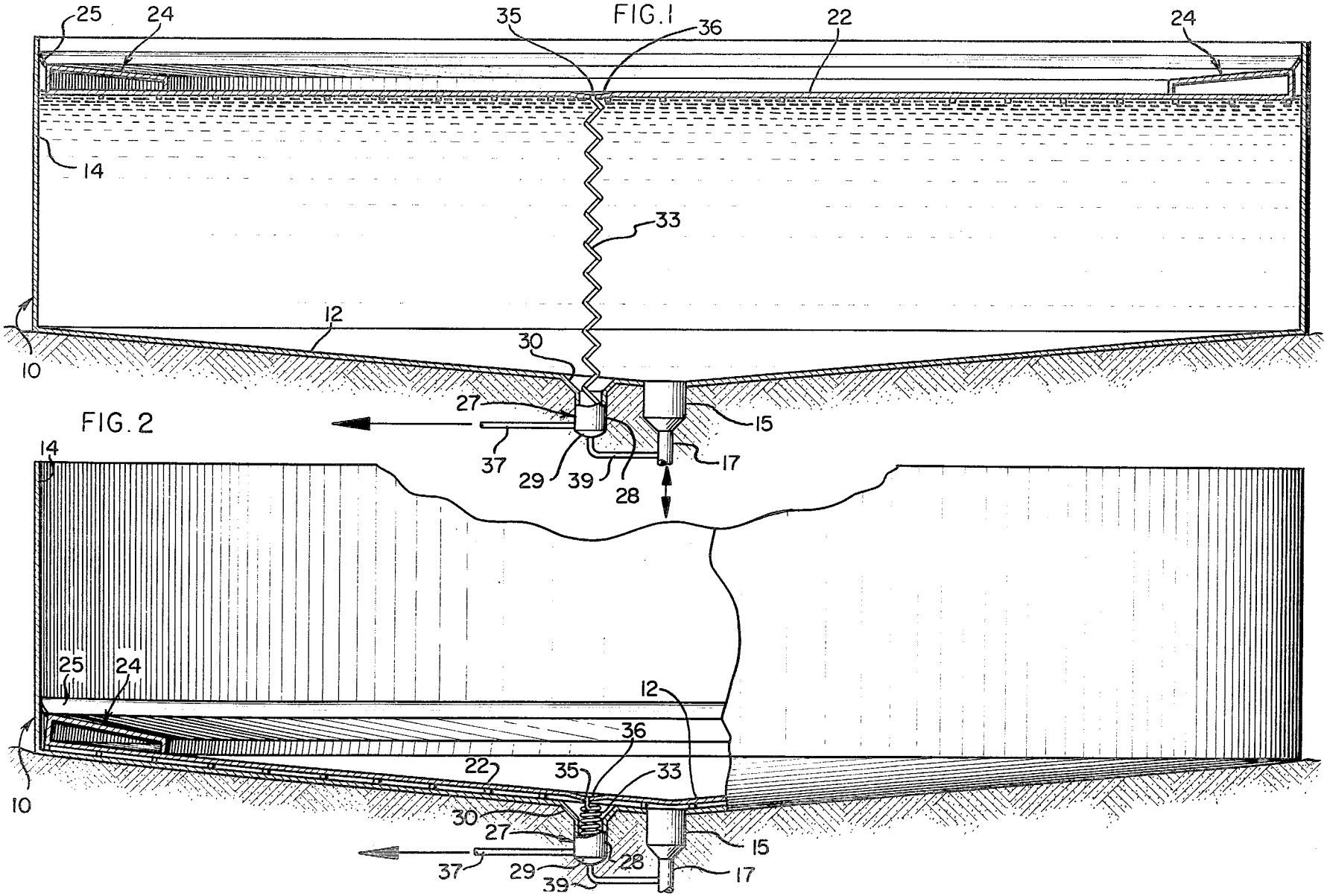
FIG. 1 is a vertical sectional view of a floating roof tank, having an inwardly sloped conical bottom, equipped with a flexible coiled hose drain shown extended from the tank bottom to the roof floating on a liquid product.
FIG. 2 is similar to FIG. 1 but shows the tank empty, the roof resting on the tank bottom, and the flexible hose in coiled, non-extended form.

With reference to FIGS. 1 and 2, the metal tank 10 has a shallow conical bottom 12, sloped to the center, and a vertical cylindrical circular wall 14 extending upwardly from the edge of the circular bottom.

Axially located in bottom 12 is a liquid product well 15 with which conduit 17 is in liquid communication. A liquid product to be stored in tank 10 can be fed in by conduit 17 and later withdrawn by the same conduit.

Floating pontoon roof 20 has a single-deck center 22 and an annular pontoon 24 at the periphery of the deck. The rim or vapor space between the roof edge and the tank wall is sealed by seal strip 25, it being understood that any one of many other known seals can be used for this purpose.

A housing 27 is located below the surface of the tank bottom 22. Housing 27 has a cylindrical shell body 28, dished bottom 29 and a frusto-conical upper part 30. The end of the housing upper part 30 is joined to the tank bottom and communicates with the tank interior space. A flexible coiled hose 33 extends from the housing 27 to an opening 35 in the deck 22. The area around the opening 35 is desirably sunken to provide a sump space 36 on the roof into which water can flow and then drain into hose 33. The lower end of hose 33 communicates with conduit 37 which extends outwardly as far as necessary to dispose of the drained water.

When the tank 10 is full of a liquid product the flexible coiled hose 33 will be nearly completely fully extended as shown in FIG. 1. However, when the tank is empty, and the floating roof rests on the tank bottom, the hose 33, in coiled non-extended state, will be located in housing 27. Obviously, as liquid is fed into the tank the roof will slowly rise from the position shown in FIG. 2 and will float on the liquid surface as its level rises. The hose will simultaneously extend vertically as the roof moves upwardly and it will retract simultaneously with lowering of the liquid level.

Since the coiled hose is hollow, and usually contains no water, it will be buoyant in stored liquid unless it is ballasted intermittently or continuously for most of its length. Metal rod can be incorporated in the hose as ballast, or weights can be applied externally on the hose, as needed.

A conduit 39 is provided extending from the bottom of housing 27 to conduit 17 so that liquid product and/or any accumulated water which enters the tank and gathered in the housing 27, around the coiled hose can be drained out to completely empty the tank.

Figure 3:
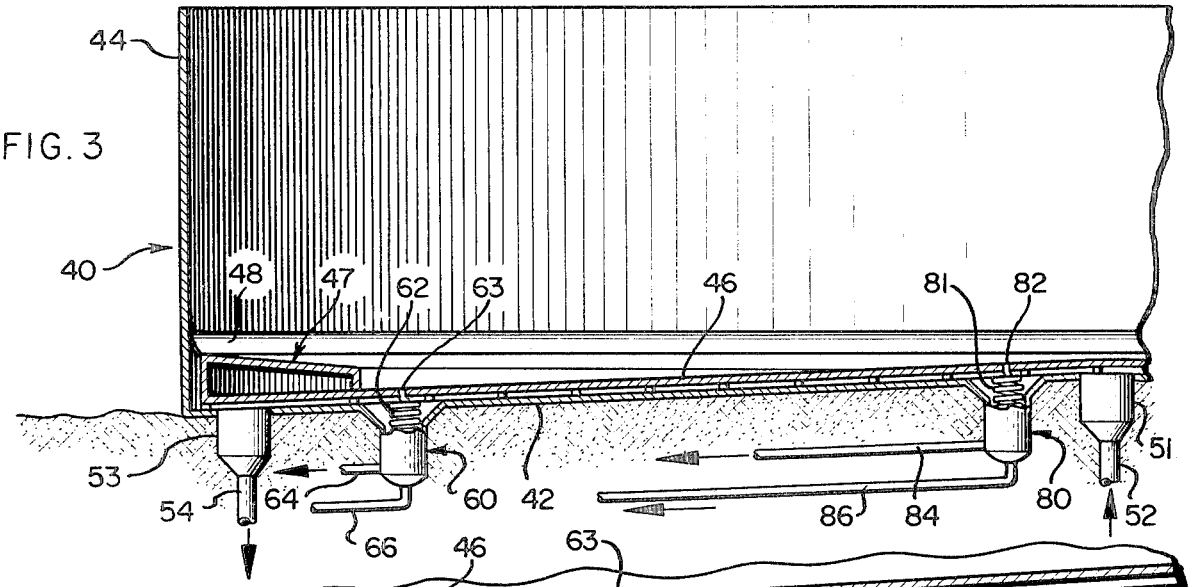
FIG. 3 is a partial vertical sectional view of a floating roof tank, having an outwardly sloped conical bottom, equipped with two flexible coiled hose drains.

FIG. 3 illustrates a floating roof tank 40 having two flexible hose drains. The floating roof tank 40 has a conical bottom 42, which slopes downwardly from the center, and a vertical circular wall 44. The floating roof has a central single deck 46, a peripheral pontoon 47 and vapor space seal 48.

Liquid product well 51 is located axially in the tank bottom 42. Conduit 52 communicates with product well 51 and can be used to feed a liquid product into the tank for storage. Another liquid product well 53 is located near the tank bottom edge at the lowest place so that liquid product will flow into it when liquid product is withdrawn from the tank and the tank is emptied. Conduit 54 communicates with well 53 and it can be used to remove liquid product from the well.

Two identical but spaced-apart housings 60 and 80 are located below the surface of tank bottom 42. Flexible coiled hose 62 is in communiction with housing 60 and with an opening 63 in the deck 46 near the inner edge of pontoon 47. Deck opening 63 is located about at the lowest area or sump on deck 46 so that water on the deck will flow to it and then into the hose when the roof is on the tank bottom and the deck slopes downwardly away from the center. The bottom end of hose 62 communicates with conduit 64 extending through housing 60.

When the roof is floating, the deck 46 can become dished and slope downwardly towards the deck center so that water which falls on the deck will flow to the deck center and accumulate there. Accordingly, a flexible drain hose 81 in coil form located in housing 80 extends to opening 82 located in the lowest area of the deck when it is dished as described. The bottom end of hose 81 communicates with conduit 84 extending through housing 80. The water drained from the roof can be removed by conduits 84 and 64 and delivered for disposal.

A conduit 86 extends outwardly from communication with the bottom space of housing 80 and, similarly, conduit 66 extends outwardly from communication with the bottom space of housing 60. Conduits 66 and 86 can be used to withdraw liquid product from the housings when the tank is to be emptied and cleaned.

Figure 4:
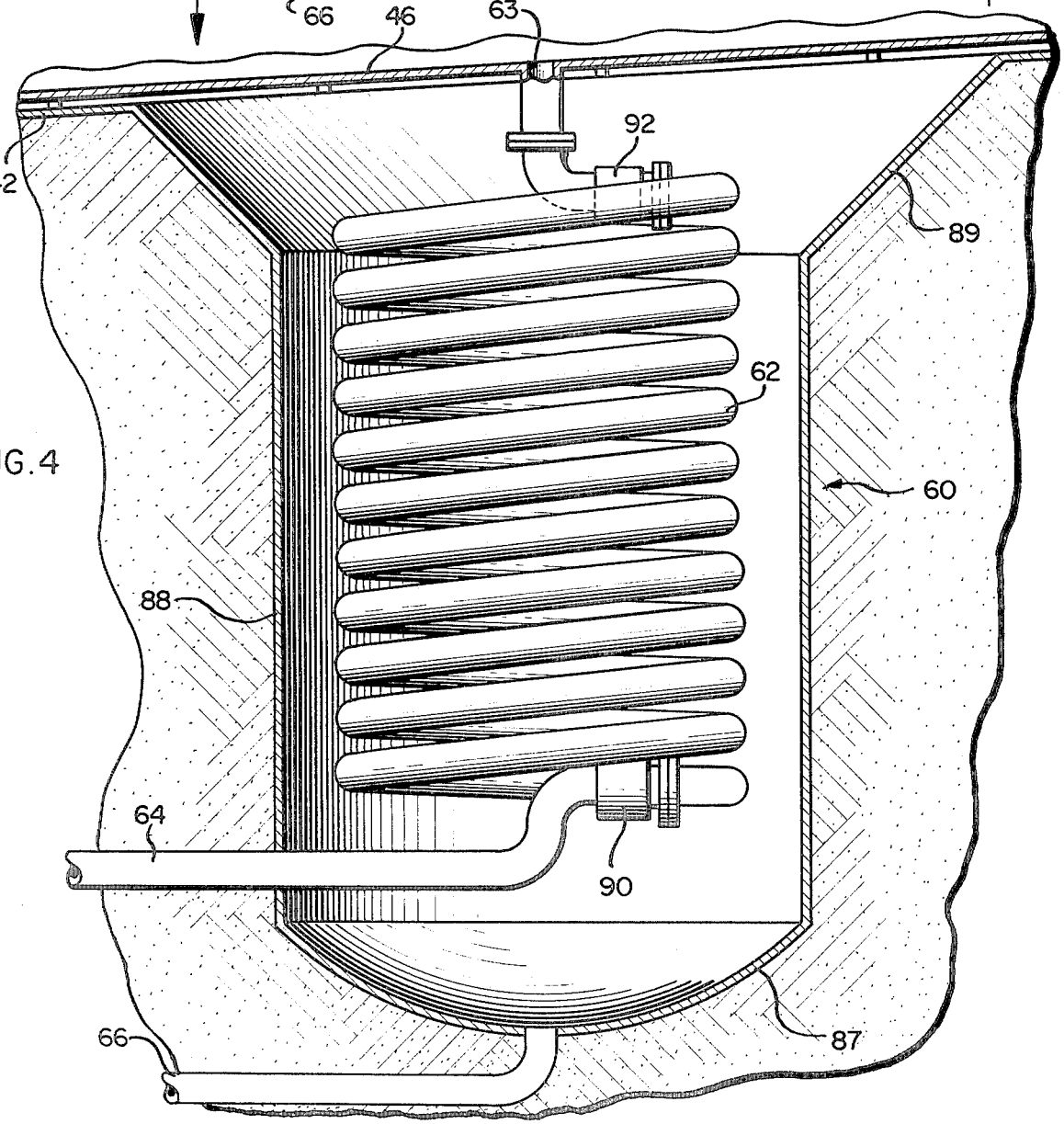
FIG. 4 is an enlarged view of one of the flexible coiled hose drains shown in FIG. 3.

FIG. 4 is an enlarged view showing housing 60 with coiled flexible hose 62 therein in a non-extended state. The housing 60 has a dished bottom 87, cylindrical shell 88 and frusto-conical upper portion 89 which has an open upper end joined to the tank bottom 42. To facilitate extending the coiled hose, a swivel 90 is located at the lower end, and a swivel 92 is located at the upper end, of the hose. It should be understood that hose 81 in housing 80 is similarly provided with swivels.

In order for the floating roof to rest on the tank bottom when the tank is empty, the flexible coiled hose is desirably placed in a housing, large enough to receive it in its non-extended state, located below the surface of the tank bottom. However, it may be feasible in some tanks to so position the hose that it is located in its non-extended state partially or entirely above the tank bottom.

Figure 5:
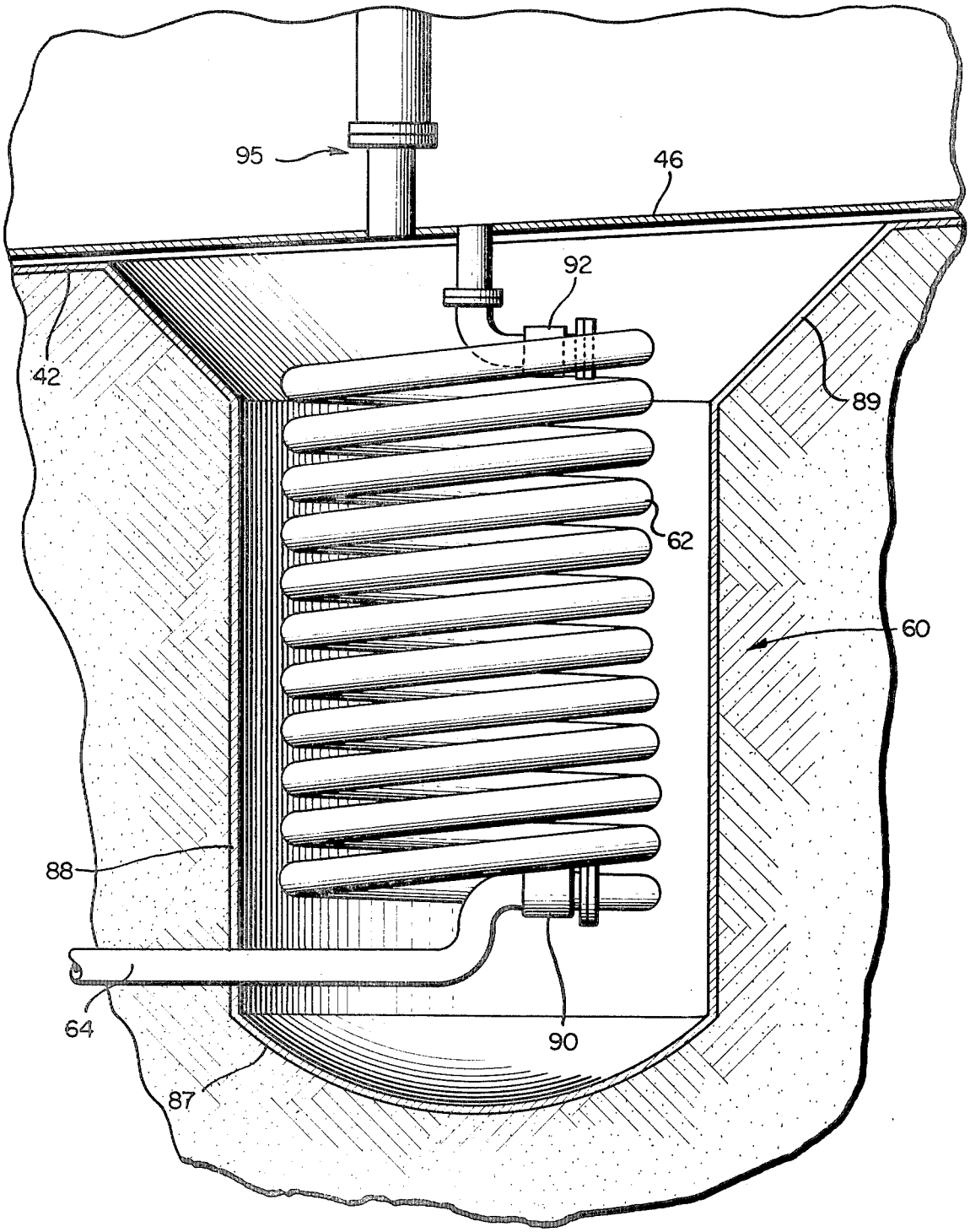
FIG. 5, which is similar to FIG. 4, shows a coiled hose housing without a drain conduit, and a nozzle in the roof for feeding a liquid to the housing.

FIG. 5 of the drawings is similar to FIG. 4. However, housing 60 is not provided with a drain 66 in the embodiment shown in FIG. 5. Furthermore, nozzle 95, mounted in the floating roof deck 46, provides a means for water, or some other liquid, to be fed directly into housing 60 when the floating roof is about at the bottom of the tank. If the liquid product to be stored in the tank has a specific gravity less than water, the housing can be filled with water rather than an expensive liquid product which would otherwise fill the space and be essentially unavailable except when the tank is to be completely emptied.

In an alternative procedure, the housing 60 could be partially filled with water and the remaining space later occupied by water which enters the tank, such as with the liquid product, and finds its way into the housing.

It should be understood that the embodiment shown in FIG. 5 can be provided with a drain 64 as shown in FIG. 4 if it is desired to remove liquid from the housing.

Although FIG. 5 illustrates a second version of housing 60, the housing 80 can also be structurally formed as in this figure, as well as in the form of the housing shown in FIG. 4.

The hoses as shown in the drawings are vertically coiled and the coils are of essentially the same diameter. The hoses, in fully coiled non-extended state, have substantially all coils pitched a distance equal to the hose external diameter.

The foregoing detailed description has been given for clearness of understanding only, and no unnecessary limitations should be understood therefrom, as modifications will be obvious to those skilled in the art.

What is claimed is:

1. In a cylindrical tank, for the storage of a liquid, having a floating roof with a diameter less than the internal diameter of the tank and adapted to float on the liquid, and with said floating roof deck being open to the weather, the drain improvement for gravity removal of water from the deck of the floating roof, comprising:

a flexible coiled hose having a lower outlet end in communication with a conduit inlet in a lower portion of the tank, and an upper inlet end in communication with a sump space on the floating roof deck, said coiled hose being extensible in length for a distance at least equal to the height the floating roof is vertically displaceable in the tank when it is full and empty of liquid, and a coiled hose housing at the tank bottom for receiving the hose in coiled form when the floating roof rests on the tank bottom.

2. The improvement according to claim 1 in which the housing is located in the tank bottom.

3. The improvement according to claim 2 in which the housing has a bottom, side walls and an open upper end joined to the tank bottom.

4. The improvement according to claim 3 in which the conduit inlet joins the lower outlet end of the hose in the lower part of the housing, and the conduit extends outwardly beneath the tank bottom.

5. The improvement according to claim 4 in which the housing bottom communicates with a drain conduit for withdrawing liquid therefrom.

6. The improvement according to claim 1 in which the roof has an opening through which liquid can be fed to the housing.

* * * * *